United States Patent [19]

Corrado

[11] Patent Number: 4,940,250

[45] Date of Patent: Jul. 10, 1990

[54] MAGNETIC KEY HOLDER

[76] Inventor: Josephine Corrado, 16951 Heather La., Mt. Clemens, Mich. 48044

[21] Appl. No.: 380,104

[22] Filed: Jul. 14, 1989

[51] Int. Cl.[5] ..... A45G 11/32

[52] U.S. Cl. ..... 206/37.1; 206/818

[58] Field of Search ..... 206/818, 813, 38.1, 206/37.1–37.8

[56] References Cited

U.S. PATENT DOCUMENTS

| | | | |
|---|---|---|---|
| 2,071,021 | 2/1937 | Brandt | 206/37.1 X |
| 2,455,968 | 12/1948 | Baker | 206/37.1 X |
| 2,527,482 | 10/1950 | Kinzler et al. | 206/818 X |
| 3,007,568 | 11/1961 | Kurland | 206/37.1 X |
| 3,212,546 | 10/1965 | Lind | 206/818 X |
| 3,213,335 | 10/1965 | Bourne | 206/818 X |
| 3,294,136 | 12/1966 | Cain et al. . | |
| 3,326,258 | 6/1967 | Stucker et al. . | |
| 3,415,300 | 12/1968 | Worcester . | |
| 3,563,293 | 2/1971 | Fisher | 206/37.1 |
| 3,682,216 | 8/1972 | Nelson . | |
| 3,727,658 | 4/1973 | Eldridge, Jr. | 206/818 X |
| 3,741,376 | 6/1973 | Brown et al. | 206/818 X |
| 3,763,996 | 10/1973 | Shepherd | 206/818 X |
| 3,978,902 | 9/1976 | Adkison . | |
| 4,004,325 | 1/1977 | Hubachek . | |
| 4,373,629 | 2/1983 | Ulin et al. | 206/818 X |

FOREIGN PATENT DOCUMENTS

| | | | |
|---|---|---|---|
| 528417 | 10/1940 | United Kingdom | 206/37.1 |
| 1087172 | 10/1967 | United Kingdom | 206/37.1 |

*Primary Examiner*—William Price

*Attorney, Agent, or Firm*—Gifford, Groh, Sprinkle, Patmore and Anderson

[57] ABSTRACT

A key holding article for removable attachment to the interior of a purse, a bag and the like. The article includes a rigid magnetic body removably attachable to the purse or bag and a metal strip having a key ring or one or more keys attached thereto. The body is coverable with a polymerized covering, either comprising a plastic coating or a layer of a plastic or vinyl material. The body is removably attachable to the interior of the purse or the bag by a pin assembly or by hook and loop mattings, one of the mattings being adherable to the interior wall of a purse or the like.

20 Claims, 1 Drawing Sheet

MAGNETIC KEY HOLDER

BACKGROUND OF THE INVENTION

I. Field of the Invention

The present invention relates to magnetic key holders. More particularly, the present invention relates to a rigid magnetic key holder removably attachable to the interior wall of a purse or a bag.

II. Description of the Relevant Art

A well-known and common scourge for people who use purses, purse-like bags and the like is the tendancy for objects placed therein to quickly work their way down to the lowest regions thereof The most commonly lost accessories are keys. This tendancy causes great frustration in that keys, which are used most frequently, seem to get lost in a purse most easily.

In response to this difficulty, the approach most commonly taken to providing key holders for purses relate to providing a hook or a hanger structure of some type to the interior wall of the purse at a selected place near the purse's opening. While more or less solving the problem of lost keys, this approach generally suffers from the fault of being inconvenient and awkward to use because of the effort and accuracy required for properly locating the keys on the key holder.

In U.S. Pat. No. 3,978,902 issued in 1976 to Adkinson, an alternate method of removably attaching keys to a key holder is disclosed. In this device, a piece of flexible magnetic material is adhered to the inner wall of the purse. The keys are attached to a metal fob that is removably attachable to the magnetic material. As an option, hooks are provided to the lower end of the magnetic material to provide support to the fob.

However, Adkinson suffers from at least three disadvantages. First, the flexible magnetic backing flexibly responds to bends or folds in the purse, thus resulting in the fob to be loosened from the magnetic base.

Second, the Adkinson magnetic tape is permanently fixed by an adhesive tape and is therefore not transferable from one purse to another.

Third, because Adkinson relies singularly on an adhesive backing, the surface to which the adhesive is adhered must be relatively smooth and free from pores. However, not all interior walls of purses are so constructed, and many are composed of a coarse fabric.

Accordingly, prior approaches to providing a convenient, reliable and interchangable key holder for removable attachment to the interior wall of a purse have failed.

SUMMARY OF THE PRESENT INVENTION

The present invention provides a key holding article for removable attachment to the interior of a purse, a bag and the like. The article includes a rigid, block-shaped magnetic body removably attachable to an interior wall of a bag or a purse. The body is preferably covered with a plastic or vinyl material to enhance its aesthetic appeal, or may be coated with a polymerized material by, for example, a dipping process.

The body is preferably removably attached to the interior wall by a pin assembly lockably fastenable to a catch similar to a safety pin. This construction allows the body to be removed and reattached to the interior wall of another purse.

As an alternative embodiment, a hook and loop fastening system is employed. The hook and loop fasteners are provided, one each, on two mattings. One of the mattings is adhered to one of the sides of the magnetic body The other matting includes an adhesive backing for attachment to the interior wall of a purse. The hook and loop fastening system allows for the body to be removed from one purse for reattachment to the interior wall of another purse, while one of the mattings is fixed to all of the user's purses or bags, thereby making a single magnetic body usable in all of the bags or purses.

A metal strip or tab is provided to which the keys or a key ring may be attached. The metal strip is attached to the magnetic body and is removably held thereby.

Other advantages and features of the present invention will become more fully understood by reference to the following detailed description of the preferred embodiments of the present invention when read in conjunction with the accompanying drawing.

BRIEF DESCRIPTION OF THE DRAWING

The present invention will become more fully understood by reference to the following detailed description of the preferred embodiments of the present invention when read in conjunction with the accompanying drawing, in which like reference characters refer to like parts throughout the views, and in which.

DETAILED DESCRIPTION OF THE PREFERRED EMBODIMENTS OF THE PRESENT INVENTION

Figure 1:
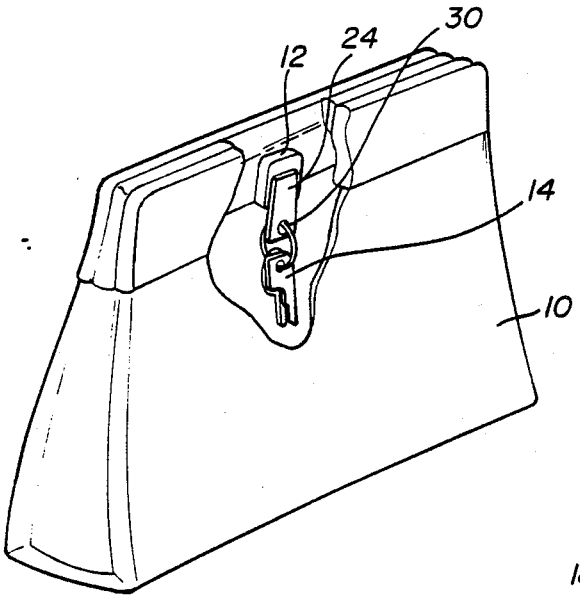
FIG. 1 is a perspective view in partial cut-away view illustrating the key holder of the present invention in place within a purse.

The drawing discloses the preferred embodiments of the present invention. While the configurations according to the illustrated embodiments are preferred, it is envisioned that alternate configurations of the present invention may be adopted without deviating from the invention as portrayed. The preferred embodiments are discussed hereafter.

Referring to FIG. 1, a purse 10 is shown having a cut-away portion whereby a key holder and key assembly 12 is illustrated. While the purse 10 is the suggested enclosure for the assembly 12, other enclosures such as bags, sacks and the like may be preferred. In any event, regardless of the type of enclosure, the assembly 12 is fitted and operates the same.

The assembly 12 is preferably fitted close to the opening of the closure as illustrated in FIG. 1. Thus situated, a key set 14 may be easily grasped, removed, and replaced. The assembly 12 offers an important advantage of preventing the key set 14 from becoming lost at the bottom of the purse 10 or similar enclosure.

Figure 2:
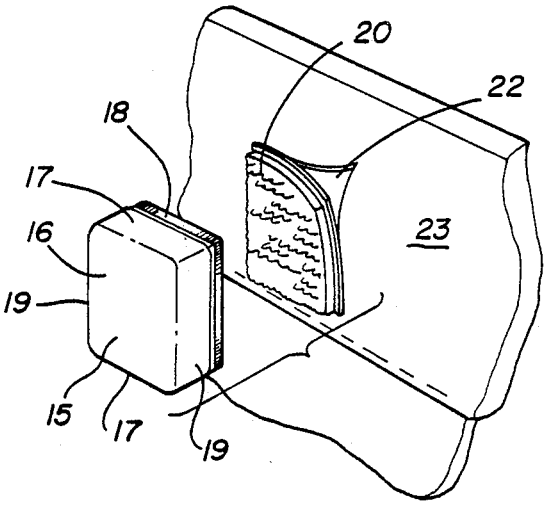
FIG. 2 is a perspective view detailing the key holder of the present invention and its method of attachment.

Referring to FIG. 2, a perspective view is illustrated detailing the preferred embodiment of a rigid magnetic body portion 16 of the assembly 12 of FIG. 1 is illustrated.

The magnetic body portion 16 is illustrated as being square-shaped, although other shapes may be used such as round- or rectangular-shaped. The body portion 16 includes a front key holding face 15, a top key holding face 17 (a bottom key holding face 17' [not visible] is situated opposite the top key holding face 17), and a first side key holding face 19 (a second side holding face 19' [not visible] is situated opposite the first side key holding-face 19). The significant design factor here is that the magnetic body portion 16 be of sufficient mass whereby the key set 14 (FIG. 1) may be held in place.

The body portion 16 may be either plastic coated through a dipping process or may be encased in a cloth, leather or vinyl covering. In any event the covering should be aesthetically pleasing.

Attachment of the body portion 16 may be accomplished preferably by use of a hook matting 18 and a loop fastener 20. The loop fastener 20 (or the hook matting 18) may be attached to the inner wall of an adhesive tape fixed to the back thereof. A protective covering 22 is removed prior to attachment of the hook matting 18 or the loop fastener 20. By the removability of this construction, the body portion 16 may be transferred from one enclosure to the next, provided all of the enclosures have affixed therein a complementary hook matting 18 or loop fastener 20.

Figure 3:
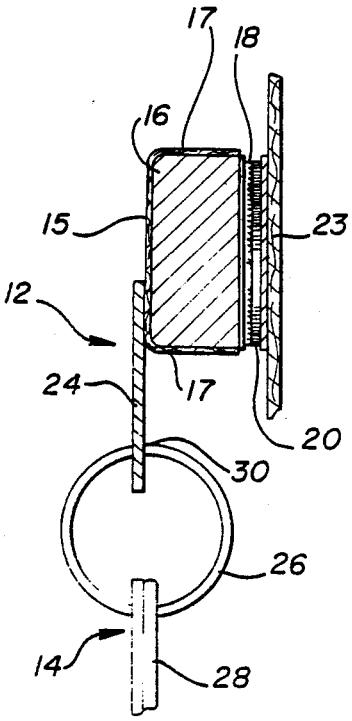
FIG. 3 is a cross-sectional view of the key holder of the present invention in place within a purse.

Referring to FIG. 3, a cross-sectional view of the key holder and key assembly 12 fitted in place to an inner wall 23 of the purse 10 is illustrated. The key set 14 is illustrated generally and includes a metal key tab 24, a key ring 26, and one or more keys 28. The tab 24 is a substantially flat piece of metal having a key ring aperture 30 defined in one of its ends (more clearly seen in FIG. 1). In lieu of a key ring 26, keys (not shown) may be directly attached to the tab 24. The tab 24 is illustrated as being attached to the front key holding face 15, although the tab 24 (or a key) may be attached to any (or all) of the other faces 17, 17', 19, 19'.

Figure 4:
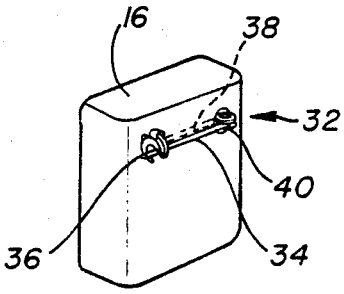
FIG. 4 illustrates an alternate embodiment of the present invention.

Referring to FIG. 4, an alternate method of attaching the body portion 16 is illustrated. According to this embodiment, a detachably attachable hook assembly 32 is illustrated and includes a first shaft 34 having a pointed end 36, a second shaft 38 (in broken lines) having a coil 40 at one of its ends and a clasp 42 at the other of its ends. The hook assembly 32 allows for the transfer of the body portion 16 from enclosure to enclosure. This embodiment allows for attachment of the body 16 to porous, uneven surfaces.

Having described my invention, however, many modifications thereto will become apparent to those skilled in the art to which it pertains without deviation from the spirit of the invention as defined by the scope of the appended claims.

I claim:

1. A key holding article comprising:

A rigid body portion including means for detachably attaching said body portion to the interior of a portable apparel enclosure;

at least one key holding portion, said at least one key holding portion being magnetically attachable to said body portion;

said rigid body portion including a back interior attaching side, a front key holding face provided opposite said back side, a top key holding face provided adjacent said front face and said back side, a bottom key holding face disposed opposite said top face, a first side key holding face provided adjacent said back side and front, top and bottom faces, and a second side key holding face disposed opposite said first side key holding face;

said at least one key holding portion being detachably attachable to one or more of said faces.

2. The key holding article of claim 1 wherein said body portion includes a covering.

3. The key holding article of claim 2 wherein said covering comprises a polymerized material.

4. The key holding article of claim 1 wherein said body portion is a magnet.

5. The key holding article of claim 4 wherein said key holding portion comprises a metal plate.

6. The key holding article of claim 5 wherein said metal plate includes an aperture defined therein for receiving a key ring.

7. The key holding article of claim 1 wherein said means for detachably attaching said body portion comprises a pin structure, said pin structure including:

a first shaft having a first pointed end and a second end;

a second shaft having a first end and a second end;

a coil, said coil interconnecting said second ends of said first and second shafts; and a clasp, said clasp being fixed to said first end of said second shaft;

whereby said first pointed end is removably interlockable with said clasp;

said second shaft being substantially fixed to said body portion.

8. The key holding article of claim 1 wherein said means for detachably attaching said body portion comprises hook and loop fasteners.

9. A key holding article comprising:

A body portion;

means for detachably attaching fixed to said body portion; and at least one key holding portion, said at least one key holding portion being magnetically attracted to said body portion;

said body portion having a plurality of substantially planar key holding portion faces whereby an equal plurality of key holding portions are removably attachable thereto.

10. The key holding article of claim 9 wherein said body portion is a magnet.

11. The key holding article of claim 10 wherein said key holding body portion comprises a metal plate.

12. The key holding article of claim 11 wherein said metal plate includes an aperture defined therein for receiving a key ring.

13. The key holding article of claim 12 wherein said means for detachably attaching comprises:

a first shaft having a pointed first end and a second end;

a second shaft having a first end and a second end;

a coil, said coil interconnecting said second ends of said first and second shafts; and a clasp, said clasp being fixed to said first end of said second shaft;

whereby said first pointed end is removably interlockable with said clasp;

said second shaft being substantially fixed to said body portion.

14. The key holding article of claim 13 wherein said body portion includes a covering.

15. The key holding article of claim 14 wherein said covering comprises a polymerized material.

16. The key holding article of claim 1 wherein said means for detachably attaching comprises a hook matting and a loop matting.

17. A key holding article comprising:

a multifaced magnetic body;

means for attaching fixed to said body; and at least one metal portion attachable to one or more keys, said at least one metal portion being removably attachable to said magnetic body;

said body having at least five faces for removably receiving one or more of said metal portions.

18. The key holding article of claim 17 wherein said means for attaching comprises two interattachable mattings, one of said mattings being attachable to the surface of an article, the other of said mattings being attachable to a face of said multifaced magnetic body.

19. The key holding article of claim 18 wherein said mattings include a first hook matting and a second loop matting.

20. The key holding article of claim 19 wherein said metal portion includes an aperture defined therein for holding one or more key rings.

* * * * *